US009102173B2

(12) United States Patent
Umeda

(10) Patent No.: US 9,102,173 B2
(45) Date of Patent: Aug. 11, 2015

(54) PRINT PROCESSING APPARATUS, CONTROL METHOD, AND STORAGE MEDIUM

(75) Inventor: Yoshinobu Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 716 days.

(21) Appl. No.: 12/876,020

(22) Filed: Sep. 3, 2010

(65) Prior Publication Data

US 2011/0058882 A1 Mar. 10, 2011

(30) Foreign Application Priority Data

Sep. 9, 2009 (JP) ..... 2009-208193

(51) Int. Cl.
*B65H 3/00* (2006.01)
*B41J 11/00* (2006.01)
*B41J 11/48* (2006.01)

(52) U.S. Cl.
CPC ..... *B41J 11/009* (2013.01); *B41J 11/485* (2013.01)

(58) Field of Classification Search
CPC ..... B65H 31/24; B65H 3201/14; B65H 3201/16; B65H 3201/10; B65H 3201/141
USPC ..... 400/76, 582; 399/405
See application file for complete search history.

(56) References Cited

U.S. PATENT DOCUMENTS 6,893,016 B2 * 5/2005 Pav et al. ..... 271/270
6,962,331 B2 * 11/2005 Matsumoto et al. ..... 270/58.09

FOREIGN PATENT DOCUMENTS

JP 08-112955 A 5/1996
JP 2005-238817 9/2005
JP 2008-023835 A 2/2008
JP 2008-186148 A 8/2008

* cited by examiner

*Primary Examiner* — David Banh
(74) *Attorney, Agent, or Firm* — Canon USA Inc. IP Division

(57) ABSTRACT

A print processing apparatus processes a print job that includes print data corresponding to a plurality of pages and first paper information relating to papers used in printing of the print data. The microprocessor unit sets second paper information relating to a paper stacking order of a paper stack including a plurality of types of papers placed in a mixed state in one paper feeding tray. Then, the microprocessor unit compares the first paper information with the second paper information. The microprocessor unit controls the printer based on an obtained comparison result so that the print data can be printed on a target paper on which the print data should be printed, and controls the printer based on the obtained comparison result so that any surplus paper other than papers that are necessary and sufficient can be separated from papers on which the print data has been printed.

8 Claims, 13 Drawing Sheets

PRINT PROCESSING APPARATUS, CONTROL METHOD, AND STORAGE MEDIUM

BACKGROUND OF THE INVENTION

1. Field of the Invention

The present invention relates to a print processing apparatus that can perform print processing using a paper stack including a plurality of types of papers that are generally placed in a mixed state in a paper feeding tray. The present invention further relates to a control method and a storage medium relating to the print processing apparatus.

2. Description of the Related Art

Business documents, such as an invoice and a statement of delivery, are representative documents (each referred to as a "unit quantity of print") that are printed according to a predetermined format. Preprint papers are usable to perform printing of the above-described business documents.

In general, the preprint papers include a regular portion printed beforehand as a fixed part that does not change depending on contents of each document.

For example, in a case where one print job includes a plurality of documents that are partly identical and partly different, each document can be easily generated by printing only variable data on each preprint paper.

In this case, the type of preprint papers used in printing of one document is not limited to only one. A plurality of types of preprint papers may be used to perform printing of one document. Further, the contents of the variable data may change in each one of a plurality of documents included in a print job. The number of preprint papers to be used in printing may change according to the contents of the variable data. The variable data is, for example, individual information that is unique to each document, such as an address and an amount of money to be printed on an invoice.

Considering the above-described situation, as discussed in Japanese Patent Application Laid-Open No. 2005-238817, there is a conventional method capable of printing a plurality of documents using a plurality of preprint papers, as a method employable in a case where the plurality of documents included in a print job are different in the number of preprint papers to be used.

The method discussed in Japanese Patent Application Laid-Open No. 2005-238817 includes sorting the preprint papers according to their types and setting the sorted preprint papers in different paper feeding trays. The conventional method further includes determining a preprint paper required in print processing of a page included in each document, selecting a paper feeding tray that can feed the determined preprint paper, and feeding the designated preprint paper from the selected paper feeding tray.

However, the method discussed in Japanese Patent Application Laid-Open No. 2005-238817 is useless in a case where the total number of types of preprint papers to be used in printing of a document is greater than the total number of usable paper feeding trays.

Further, the above-described problem is not peculiar to the preprint papers. More specifically, a similar problem will arise in a case where the number of types of papers to be used in printing of a print job is greater than the number of paper feeding trays.

SUMMARY OF THE INVENTION

According to an aspect of the present invention, a print processing apparatus processes a print job that includes print data corresponding to a plurality of pages and first paper information relating to a plurality of types of papers to be used in printing of print data corresponding to each page. The print processing apparatus according to an aspect of the present invention includes a setting unit configured to set second paper information relating to a paper stacking order of a paper stack including a plurality of types of papers that are placed in a mixed state in one paper feeding tray; a comparison unit configured to compare the first paper information with the second paper information; a print control unit configured to control a printing unit based on a comparison result obtained by the comparison unit so that the print data can be printed on a target paper on which the print data should be printed, which is selected from the plurality of types of papers fed from the paper feeding tray in processing of the print job; and a separation control unit configured to control a separation unit based on the comparison result obtained by the comparison unit so that any surplus paper other than papers that are necessary and sufficient to perform printing of the print data, which is a part of the plurality of types of papers fed from the paper feeding tray in processing of the print job, can be separated from papers on which the print data has been printed.

According to the present invention, printing of a print job can be adequately performed even in a case where the number of paper feeding trays is less than the number of types of papers to be used in printing of the print job.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
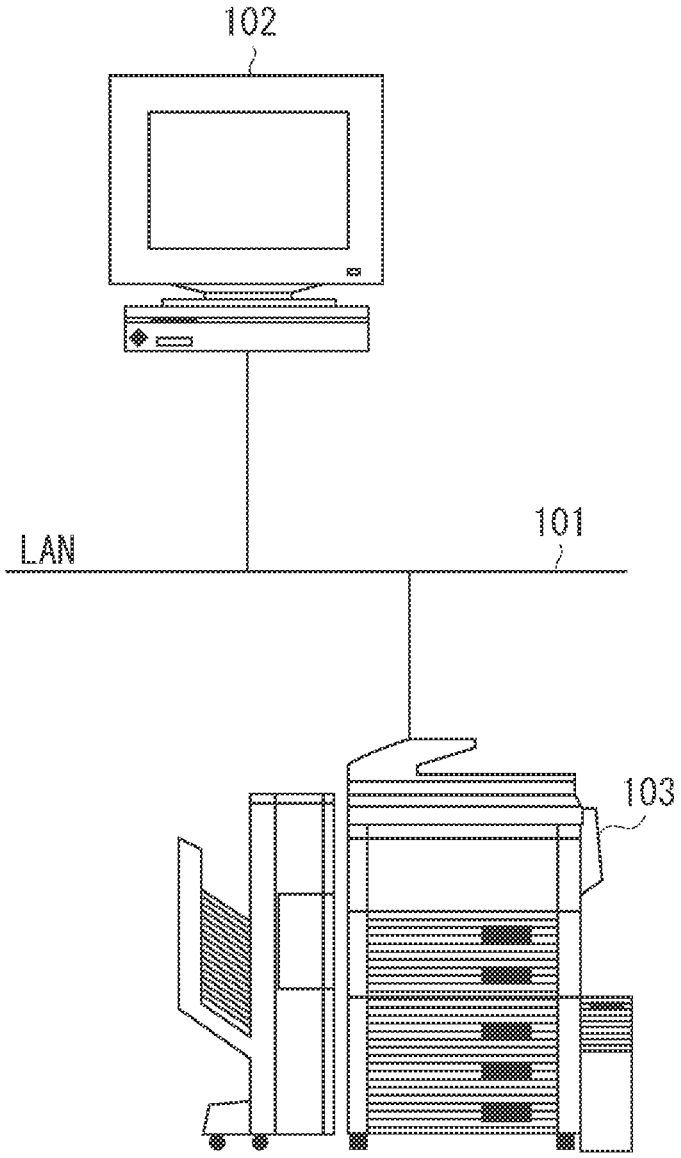
FIG. 1 illustrates an example configuration of a print processing system according to an exemplary embodiment of the present invention.

FIG. 1 illustrates a configuration of a print processing system according to an exemplary embodiment of the present invention. In the present exemplary embodiment, an information processing apparatus and an MFP are collectively referred to as print processing apparatuses, although each of the information processing apparatus and the MFP can be referred to as an independent print processing apparatus.

In FIG. 1, a computer 102 and an MFP 103 are connected via a local area network (LAN) 101. The computer 102 is functionally operable as an information processing apparatus. The MFP 103 is functionally operable as an image forming apparatus. The computer 102 enables users to perform a work for generating and editing image data. Further, in a state where the computer 102 is connected to the LAN 101, the computer 102 can transmit a print job including generated image data to the MFP 103 via the LAN 101.

In a state where the MFP 103 is connected to the LAN 101, the MFP 103 can receive a print job transmitted from the computer 102 via the LAN 101 and store the received print job in an internal storage device provided in the MFP 103. The MFP 103 can perform print processing based on the print job stored in the internal storage device thereof.

As a simplified drawing, FIG. 1 illustrates only one computer 102 and only one MFP 103 mutually connected via the LAN 101. However, it is usual that a plurality of computers and a plurality of MFPs are connected via the LAN 101. For example, the computer 102 can select a desired one of the plurality of MFPs connected to the LAN 101 and can transmit a print job to the selected MFP. In response to a reception of the print job, the selected MFP performs printing of print data included in the print job.

Figure 2:
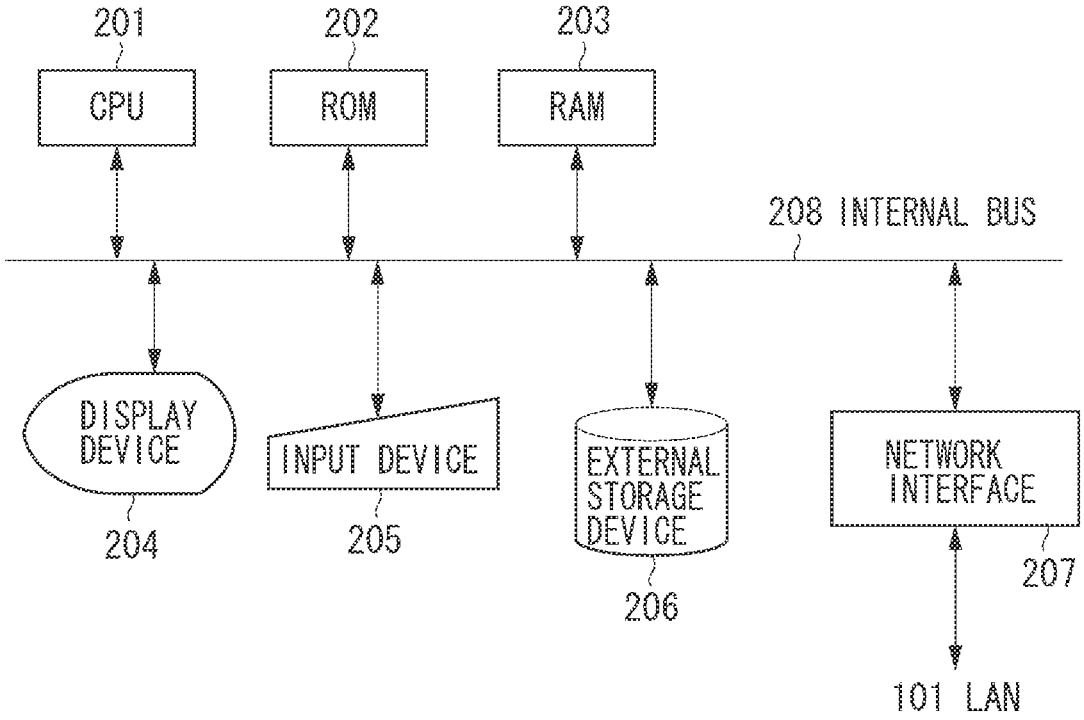
FIG. 2 is a block diagram illustrating an internal structure of a computer according to an exemplary embodiment of the present invention.

FIG. 2 is a block diagram illustrating an internal structure of the computer 102. The computer 102 illustrated in FIG. 2 includes a central processing unit (CPU) 201, a read only memory (ROM) 202, a random access memory (RAM) 203, a display device 204, an input device 205, an external storage device 206, and a network interface 207. The CPU 201 can control various operations to be performed by the computer 102.

The ROM 202 is a storage device capable of storing various control software programs that can be processed by the CPU 201. The RAM 203 is a storage device into which an application software program can be temporarily loaded from the external storage device 206. The CPU 201 can execute processing according to the software program loaded in the RAM 203. Further, the RAM 203 can provide a work area for the CPU 201 when the CPU 201 executes various controls.

The display device 204 can perform various display operations under the control of the CPU 201. The input device 205 includes a keyboard and a pointing device, which enable users to input information and data required in the operation performed by the computer 102. The external storage device 206 is a detachable storage device that is capable of storing various application software programs and related data. The network interface 207 can control data communications to be performed between the computer 102 and other devices via the network. The LAN 101 illustrated in FIG. 1 is connected to the network interface 207. The computer 102 is connected to the LAN 101 via the network interface 207.

The CPU 201, the ROM 202, the RAM 203, the display device 204, the input device 205, the external storage device 206, and the network interface 207 are connected with each other via an internal bus 208 of the computer 102.

Figure 3:
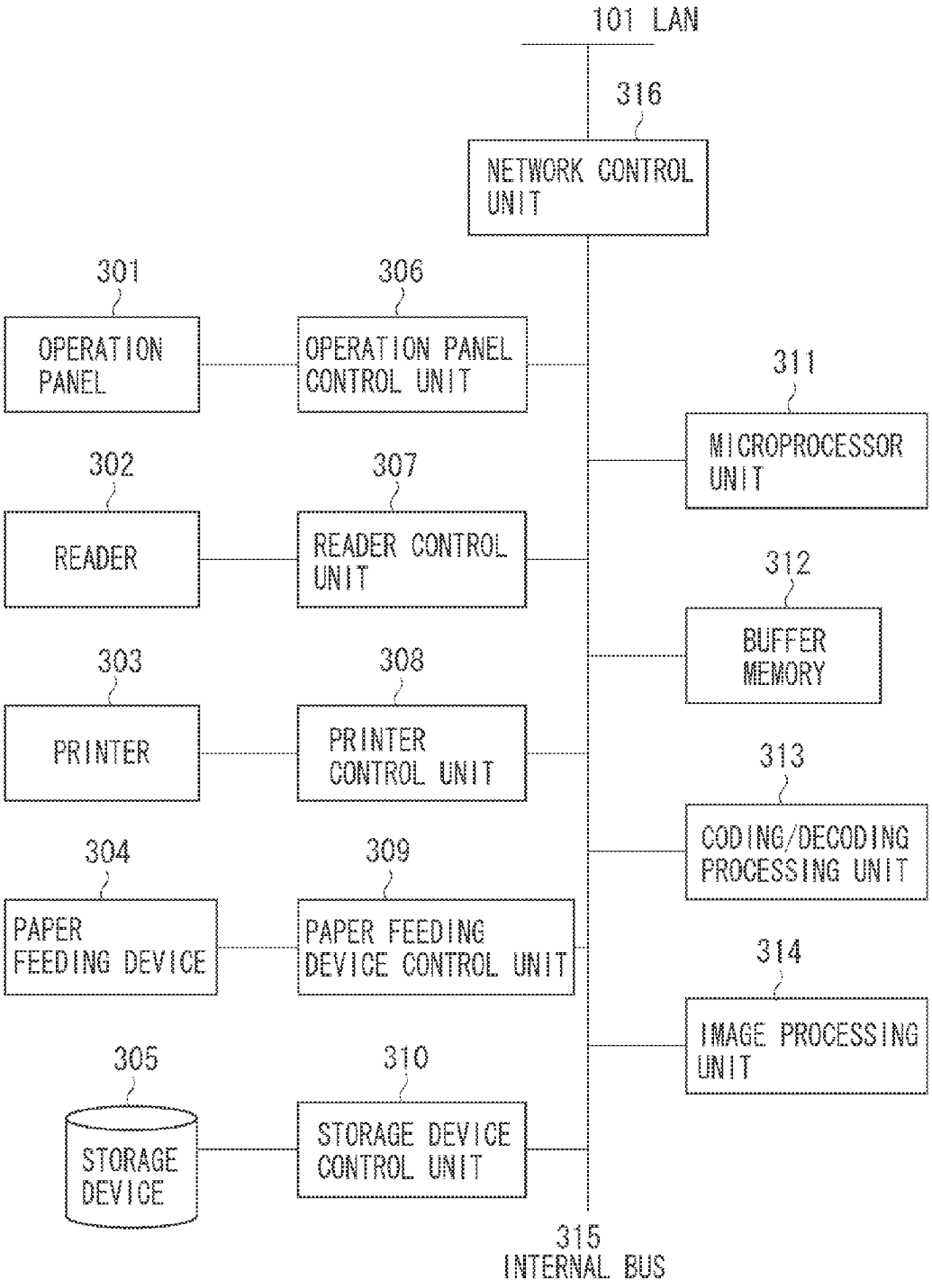
FIG. 3 is a block diagram illustrating an internal structure of a multifunction peripheral (MFP) according to an exemplary embodiment of the present invention.

FIG. 3 is a block diagram illustrating an internal structure of the MFP 103. The MFP 103 illustrated in FIG. 3 includes an operation panel 301, a reader (i.e., a reading unit) 302, a printer 303, a paper feeding device 304, a storage device 305, an operation panel control unit 306, a reader control unit 307, a printer control unit 308, a paper feeding device control unit 309, a storage device control unit 310, a microprocessor unit 311, a buffer memory 312, a coding/decoding processing unit 313, an image processing unit 314, and a network control unit 316.

The operation panel 301 includes dials and switches that can be operated by users to instruct a copy operation or a facsimile transmission operation, perform settings relating to enlargement/reduction/copy ratio, and input a telephone number indicating a transmission destination.

The reader 302 can generate an image signal by photoelectrically scanning a document (i.e., an original) to be transmitted. The reader 302 includes a row of photoelectric elements (e.g., CCDs) disposed along a main scanning direction and movable in a direction perpendicular to the row direction of the photoelectric elements (i.e., in a sub scanning direction) to read a document (i.e., an original) placed on a document positioning plate. The reader 302 generates electric image data representing the document (i.e., the original) read in the above-described scanning operation. The image data generated by the reader 302 is stored in the buffer memory 312 via the reader control unit 307.

The printer 303 can form an image on a recording paper based on the image data generated by the reader 302 or image data received via the LAN 101. The MFP 103 according to the present exemplary embodiment is, for example, a printer of an electrophotographic type. An operation for outputting image data to the printer 303 can be performed by sending the image data stored in the buffer memory 312 to the printer 303 via the printer control unit 308.

The paper feeding device 304 can feed a paper stack that is composed of recording papers, which can be used by the printer 303 to print image data. The paper feeding device 304 includes a plurality of paper feeding trays and can feed a recording paper from any one of the paper feeding trays to the printer 303, which is selected in accordance with an instruction sent from the microprocessor unit 311 or an instruction input by a user via the operation panel 301.

The storage device 305 is, for example, a hard disk drive or a nonvolatile memory that can store image data read by the reader 302 and image data received via the LAN 101.

The operation panel control unit 306 can control the operation panel 301. For example, the operation panel control unit 306 analyzes a user instruction input via the operation panel 301, and sends the contents of the received instruction to the microprocessor unit 311.

The reader control unit 307 can control the reader 302. For example, the reader control unit 307 drives the reader 302 according to an instruction sent from the microprocessor unit 311 to read a document (i.e., an original) placed on the document positioning plate and stores the read image data into the buffer memory 312.

The printer control unit 308 can control the printer 303. For example, the printer control unit 308 acquires image data from the buffer memory 312 according to an instruction received from the microprocessor unit 311 and outputs the acquired image data to the printer 303. Further, the printer control unit 308 drives the printer 303 in synchronization with the output of image data to print an image on a recording paper and discharge the printed paper.

The paper feeding device control unit 309 can control the paper feeding device 304. For example, the paper feeding device control unit 309 acquires information relating to the recording papers placed in the paper feeding device 304, such as size, presence, and remaining number of papers. The paper feeding device control unit 309 sends the acquired information to the microprocessor unit 311. Further, in a case where the printer 303 performs a print operation, the paper feeding device control unit 309 controls the paper feeding device 304 so that a recording paper instructed by the microprocessor unit 311 or the operation panel 301 can be supplied from the paper feeding device 304 to the printer 303.

The storage device control unit 310 can control the storage device 305. For example, the storage device control unit 310 performs processing for transferring data from the buffer memory 312 to the storage device 305 and outputting data from the storage device 305 to the buffer memory 312 according to an instruction sent from the microprocessor unit 311.

The microprocessor unit 311 can control various operations to be performed by the MFP 103. For example, the microprocessor unit 311 sends an instruction to each block so that the MFP 103 can perform scanning, printing, and facsimile reception/transmission operations. Further, the microprocessor unit 311 includes a ROM that stores software programs required to perform operations of the MFP and a RAM that temporarily stores data required for the controls of the MFP.

The buffer memory 312 is a memory that can be temporarily used in a case where image data is read from a document (i.e., an original) by the reader 302, in a case where image data is read from the storage device 305, or in a case where image data is acquired via the LAN 101.

Further, in a case where the printer 303 prints image data, or in a case where image data is stored in the storage device 305, or in a case where image data is output via the LAN 101, the image data is output from the buffer memory 312.

The coding/decoding processing unit 313 can perform, if necessary, coding processing (compression processing) on the image data stored in the buffer memory 312 or can perform decoding processing (decompression processing) on the compressed image data.

The image processing unit 314 can perform image processing or any other processing for improving the image quality according to a user instruction input via the operation panel 301.

The functional blocks 306 to 314 and 316 are mutually connected via an internal bus 315. Transfer of image data and transmission/reception of commands and setting values required in operations of respective blocks can be performed via the internal bus 315.

The internal bus 315 is connected to the external LAN 101 via the network control unit 316. The network control unit 316 controls protocol conversions performed between the external LAN 101 and the internal bus 315. Therefore, not only the image data read by the reader 302 but also image data input via the external LAN 101 can be stored into the buffer memory 312. The printer 303 performs print processing based on the image data stored in the buffer memory 312 and discharges a printed paper. Further, the image data input via the external LAN 101 can be stored in the storage device 305.

In the present exemplary embodiment, it is necessary for the MFP 103 to set paper set information relating to a paper set of preprint papers placed in the paper feeding device 304, which is referred to as "second paper information", before the MFP 103 performs print processing.

An example method for setting paper set information using the operation panel 301 is described below. In the present exemplary embodiment, the paper set is an assembly of a plurality of types of papers arranged in a predetermined stacking order.

A plurality of paper sets are placed one on top of another in a paper feeding tray to constitute a paper stack. The paper set information includes at least a stacking order of the papers included in each paper set.

FIGS. 4A to 4D illustrate examples of various screens that can be displayed on the operation panel 301 by the operation panel control unit 306, to enable users to perform settings with respect to paper set information of respective paper feeding trays included in the paper feeding device 304.

Figure 4A:
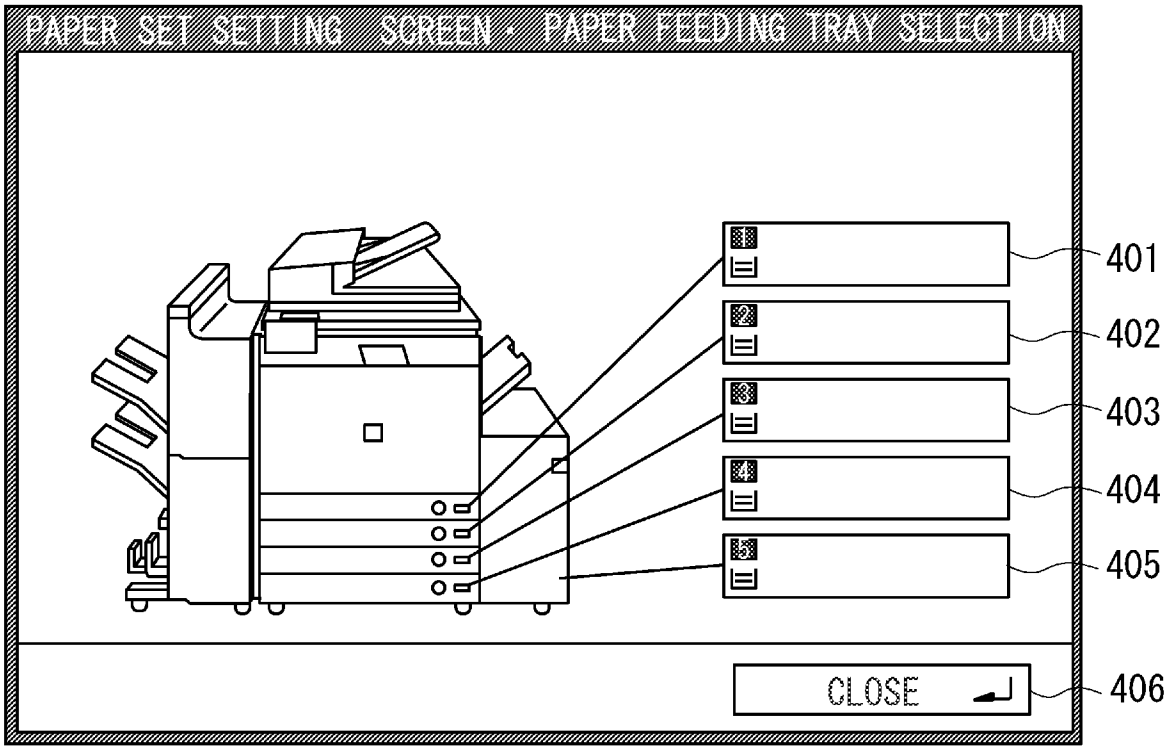
FIG. 4A illustrates an example of a paper feeding tray selection screen according to an exemplary embodiment of the present invention.

FIG. 4A illustrates an example of a paper feeding tray selection screen, which enables users to perform setting of paper set information. On the selection screen illustrated in FIG. 4A, a user selects a paper feeding tray to which the paper set information is set and presses a button (i.e., one of buttons 401 to 405) that corresponds to the selected paper feeding tray.

The button 401 represents the uppermost paper feeding tray provided in the MFP body. The button 402, the button 403, and the button 404 represent the second, the third, and the lowermost paper feeding trays provided in the MFP body, respectively. The button 405 represents an external paper feeding tray that is attachable to the MFP body.

Figure 4B:
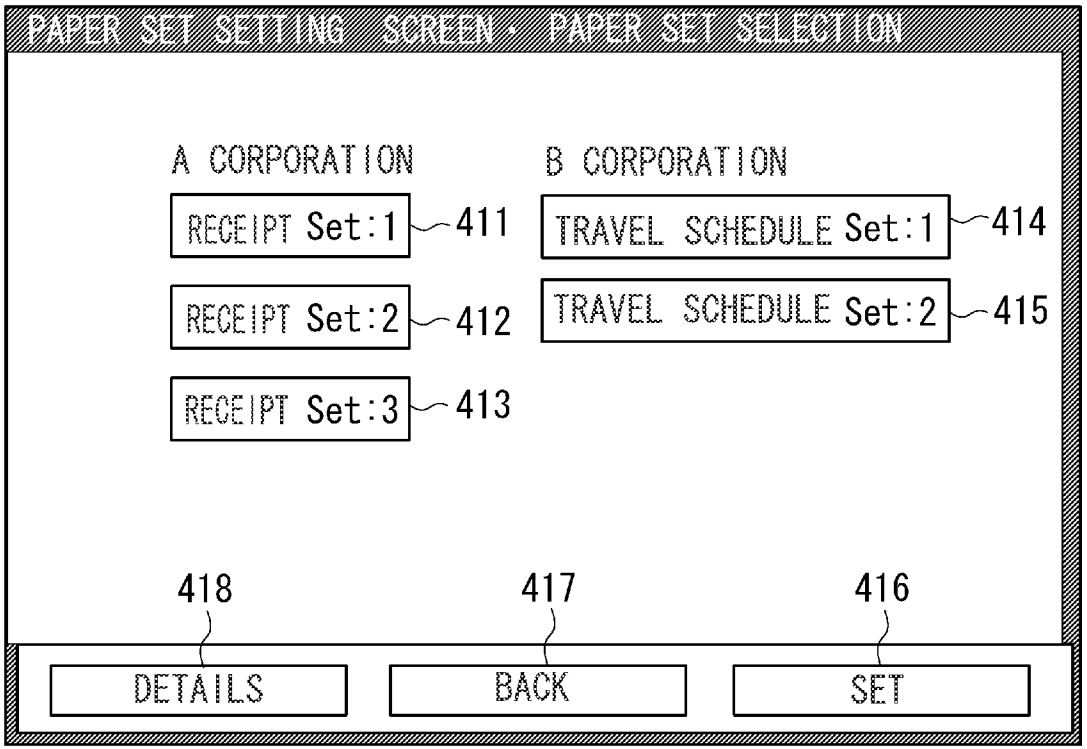
FIG. 4B illustrates an example of a selection screen that enables users to designate a paper set to be placed in a paper feeding tray according to an exemplary embodiment of the present invention.

FIG. 4B illustrates an example of a selection screen that enables users to select a paper set having been set or to be set in the paper feeding tray selected by the user on the selection screen illustrated in FIG. 4A. The selection screen illustrated in FIG. 4B can be displayed when the button 401 is pressed by a user on the screen illustrated in FIG. 4A and "paper feeding tray 1" is selected as a setting target paper feeding tray.

Similarly, when each of other buttons 402 to 405 illustrated in FIG. 4A is pressed, a screen enabling users to set paper set information for the paper feeding tray corresponding to the selected button can be displayed.

The selection screen illustrated in FIG. 4B includes buttons 411 to 415 indicating names of a plurality of paper sets of preprint papers that are selectable. If any one of the buttons 411 to 415 is pressed by the user, a paper set corresponding to the selected button can be set for the setting target paper feeding tray.

If a "Set" button 416 is pressed in a state where any one of the buttons 411 to 415 is selected, the microprocessor unit 311 sets paper set information corresponding to the selected button, which is stored in the storage device 305, for the setting target paper feeding tray.

Further, if a "Return" button 417 is pressed by the user, the operation panel control unit 306 controls the operation panel 301 to display the screen illustrated in FIG. 4A again without performing any paper set settings. Further, if a "Details" button 418 is pressed by the user, the operation panel control unit 306 controls the operation panel 301 to display detailed information of the paper set that corresponds to the selected one of the buttons 411 to 415.

Figure 4C:
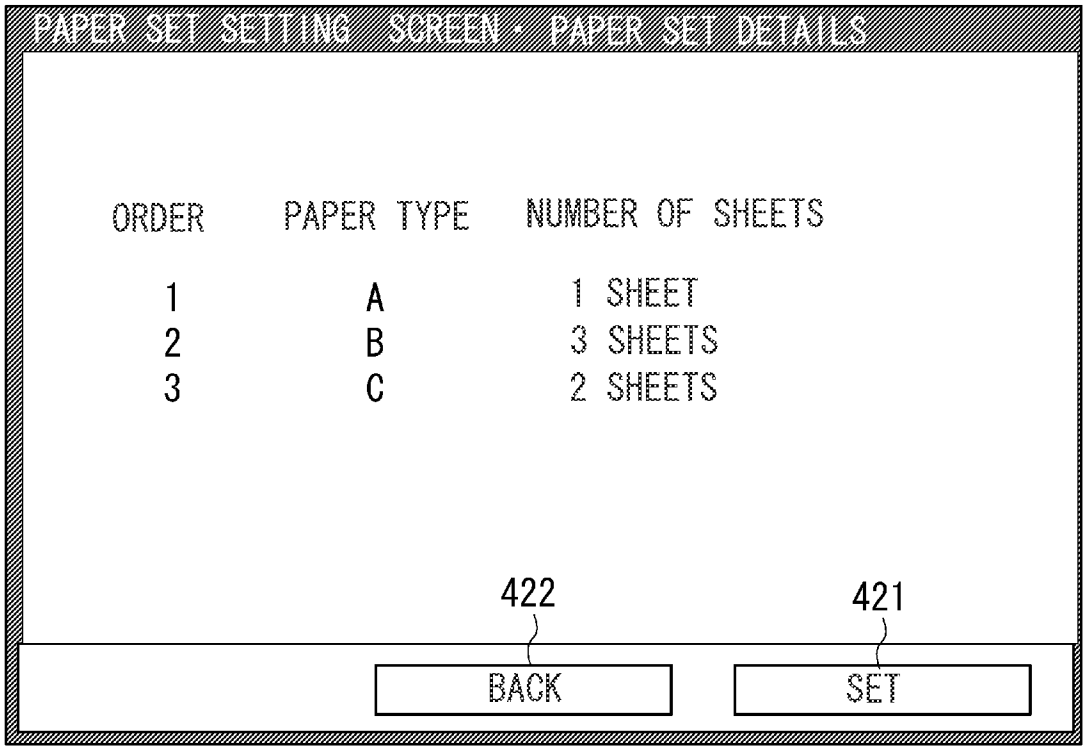
FIG. 4C illustrates an example of a screen that displays details of paper set information according to an exemplary embodiment of the present invention.

FIG. 4C illustrates an example of a screen that can be displayed on the operation panel 301 by the operation panel control unit 306 when the "Details" button 418 is pressed on the selection screen illustrated in FIG. 4B.

FIG. 4C illustrates detailed contents of the paper set named "Receipt Set: 1", which includes display items of order, paper type, and number of sheets with respect to a plurality of types of papers included in the paper set.

According to the illustrated example, the paper set named "Receipt Set: 1" is a paper set including one sheet of paper A, three sheets of paper B, and two sheets of paper C, which are arranged in this order.

In this case, a plurality of above-described paper sets is prepared as a paper stack and placed in the paper feeding tray.

If a "Back" button 422 is pressed on the screen illustrated in FIG. 4C, the screen illustrated in FIG. 4B is displayed again. Subsequently, if a "Set" button 411 is pressed, the microprocessor unit 311 sets the paper set information whose detailed information was displayed for the setting target paper feeding tray. In this case, detailed information is not limited to the contents of the screen illustrated in FIG. 4B. For example, the screen illustrated in FIG. 4C can be modified so as to include a display of any other item such as a preview image of a paper.

Figure 4D:
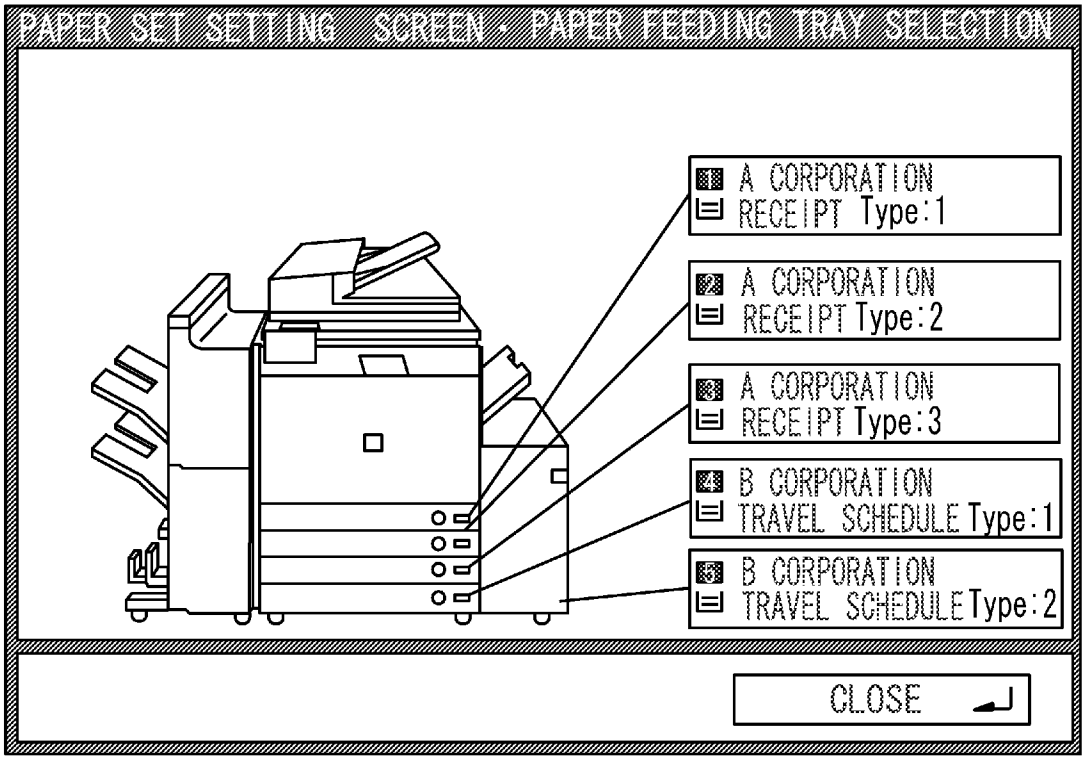
FIG. 4D illustrates another example of the paper feeding tray selection screen that can be displayed after the setting of paper set information is completed according to an exemplary embodiment of the present invention.

FIG. 4D illustrates an example of the paper feeding tray selection screen that can be displayed after the setting of paper set information for each paper feeding tray is completed. The screen illustrated in FIG. 4D can be displayed, for example, when a user presses the button 401 to open the screen illustrated in FIG. 4B and further presses the button 411 to select the "Receipt Set: 1."

The illustration of FIG. 4D indicates a state where a paper stack composed of a plurality of paper sets corresponding to the "Receipt Set: 1" and placed one on top of another is stored in the uppermost paper feeding tray provided in the MFP body.

Similarly, if any one of the paper feeding trays corresponding to the buttons 402 to 405 is selected, the selection screen illustrated in FIG. 4D indicates a state where a paper stack composed of a plurality of paper sets having corresponding paper set information is stored in the selected paper feeding tray.

According to the example illustrated in the present exemplary embodiment, if the name "Receipt Set: 1" is selected on the screen illustrated in FIG. 4B, the microprocessor unit 311 sets paper set information corresponding to the selected receipt name, which is stored beforehand in the storage device 305.

Hereinafter, an example method for setting paper set information to the storage device 305 according to the present exemplary embodiment is described below.

To acquire paper set information, the MFP 103 accesses the web site of a company selling paper sets via a network and downloads paper set information from the site. The MFP 103 stores acquired paper set information into the storage device 305.

Similar to the MFP 103, the information processing apparatus (e.g., the computer 102) can access the web site of the selling company to download paper set information. In this case, the information processing apparatus transmits the downloaded paper set information to the storage device 305 of the MFP 103.

Further, it is useful to put a two-dimensional code (e.g., a bar code or a QR code) on a packing of a paper set or a paper itself, so that paper set information can be acquired based on the attached two-dimensional code.

Further, in a case where a user memorizes paper set information, the microprocessor unit 311 can set paper set information (e.g., order, paper type, and number of sheets) of a paper set according to a user instruction entered via an operation screen of the MFP 103 or the computer 102.

Further, according to the method described in the above-described exemplary embodiment, users can operate the operation panel 301 to input paper set information of the preprint papers placed in the paper feeding device 304.

However, a similar work can be performed by a user who operates the computer 102. In this case, the computer 102 accesses the MFP 103 via the LAN 101 and activates a dedicated web browser to perform operations similar to those realized by the operation panel 301.

Figure 5:
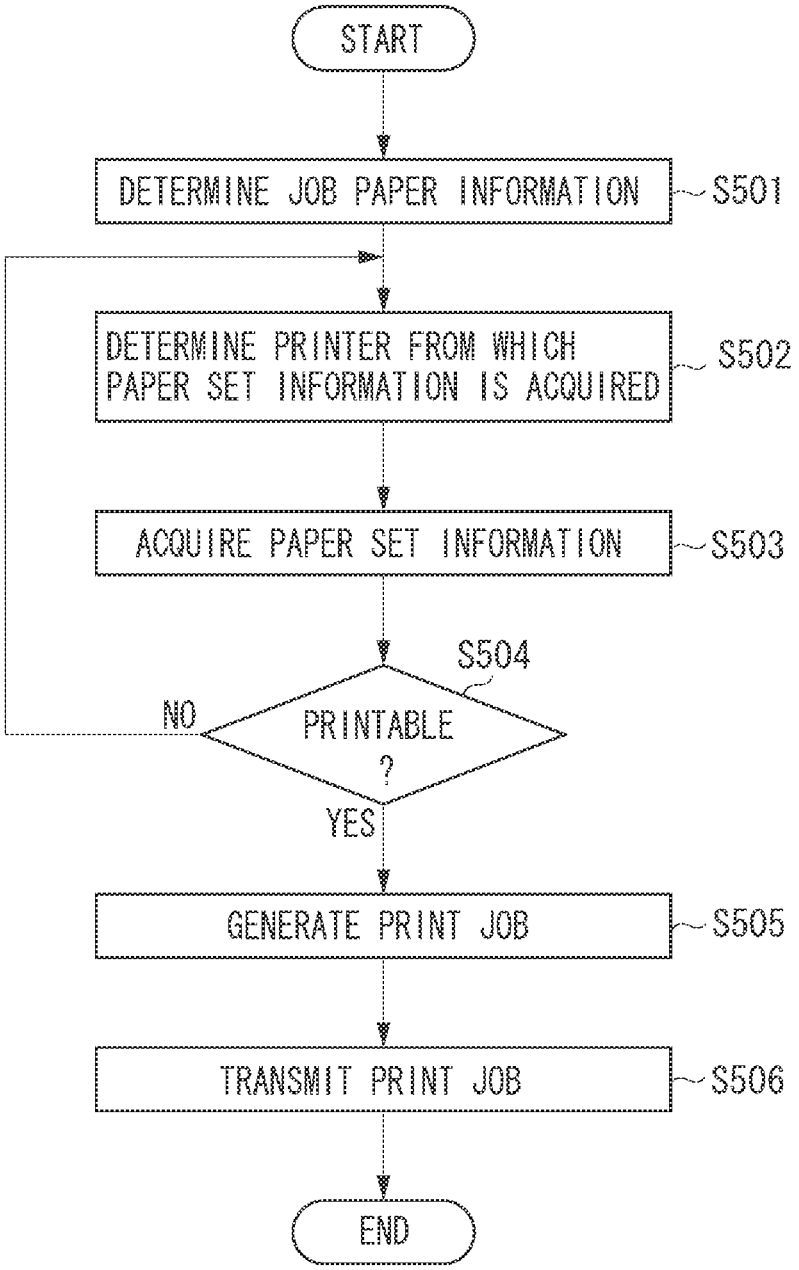
FIG. 5 is a flowchart illustrating an operation of a central processing unit (CPU) according to an exemplary embodiment of the present invention.

FIG. 5 is a flowchart illustrating an operation of the CPU 201 according to the present exemplary embodiment, which can be performed when the computer 102 generates a print job and transmits the generated print job to the MFP 103.

First, if the computer 102 receives a print request, then in step S501, the CPU 201 stores print data into the RAM 203 and determines job paper information, as first paper information, which represents information relating to a preprint paper on which printing of stored print data is performed.

The job paper information to be determined in step S501 includes a paper type (e.g., a format defining a regular portion) of a preprint paper to be used in printing, number of required preprint papers for each paper type, and stacking order. Further, print data determined in this case correspond to each unit quantity of print that is composed of at least one page. The unit quantity of print according to the present exemplary embodiment is a document included in each print job. The number of pages included in each document is variable depending on each document. Therefore, the number of pages included in each document is not a fixed value.

Next, in step S502, the CPU 201 determines a printer from which paper set information is acquired via the LAN 101 according to a print target printer selection instruction received from a user via the input device 205. Then, in step S503, the CPU 201 acquires paper set information from the storage device 305 of the printer determined in step S502 (the MFP 103 in the present exemplary embodiment) via the LAN 101.

Next, in step S504, the CPU 201 determines whether the print job is printable by the MFP 103 (i.e., the printer selected by the user) based on a comparison between the acquired paper set information and the determined job paper information.

If it is determined that the job paper information is encompassed in the acquired paper set information, the CPU 201 determines that the print job is printable by the MFP 103 (YES in step S504) and the processing proceeds to step S505. On the other hand, if it is determined that the job paper information is not encompassed in the acquired paper set information, the CPU 201 determines that the print job is not printable by the MFP 103 (NO in step S504) and the processing returns to step S502 in which the CPU 201 receives again a printer selection instruction from the user.

In the present exemplary embodiment, it can be determined that the job paper information is encompassed in the paper set information if the number of papers of a predetermined paper type to be used in printing of print data of each unit quantity of print (i.e., a document) is equal to or less than the number of papers of a predetermined paper type included in the paper set.

In the illustration of FIG. 1, the MFP 103 is only one printer connected to the LAN 101. However, it is usual that two or more printers (not illustrated) are connected via the LAN 101.

If it is determined that the print job is printable by the MFP 103 (YES in step S504), then in step S505, the CPU 201 generates a print job based on the print data. The print job generated in step S505 includes print data corresponding to a plurality of unit quantities of print and job paper information relating to a paper on which each page is printed. The print job to be generated in step S505 is described below in more detail with reference to FIG. 7. Finally, in step S506, the CPU 201 transmits the print job generated in step S505 to the MFP 103 that performs a printing operation based on the received print job.

In the above-described processing of steps S502 and S503 illustrated in FIG. 5, the CPU 201 accesses the printer connected to the LAN 101 and acquires information relating to the preprint papers stored in a paper feeding device of the printer. However, if the computer 102 stores information beforehand with respect to the preprint papers stored in the MFP, the computer 102 can select a printable printer referring to the stored information.

Figure 6:
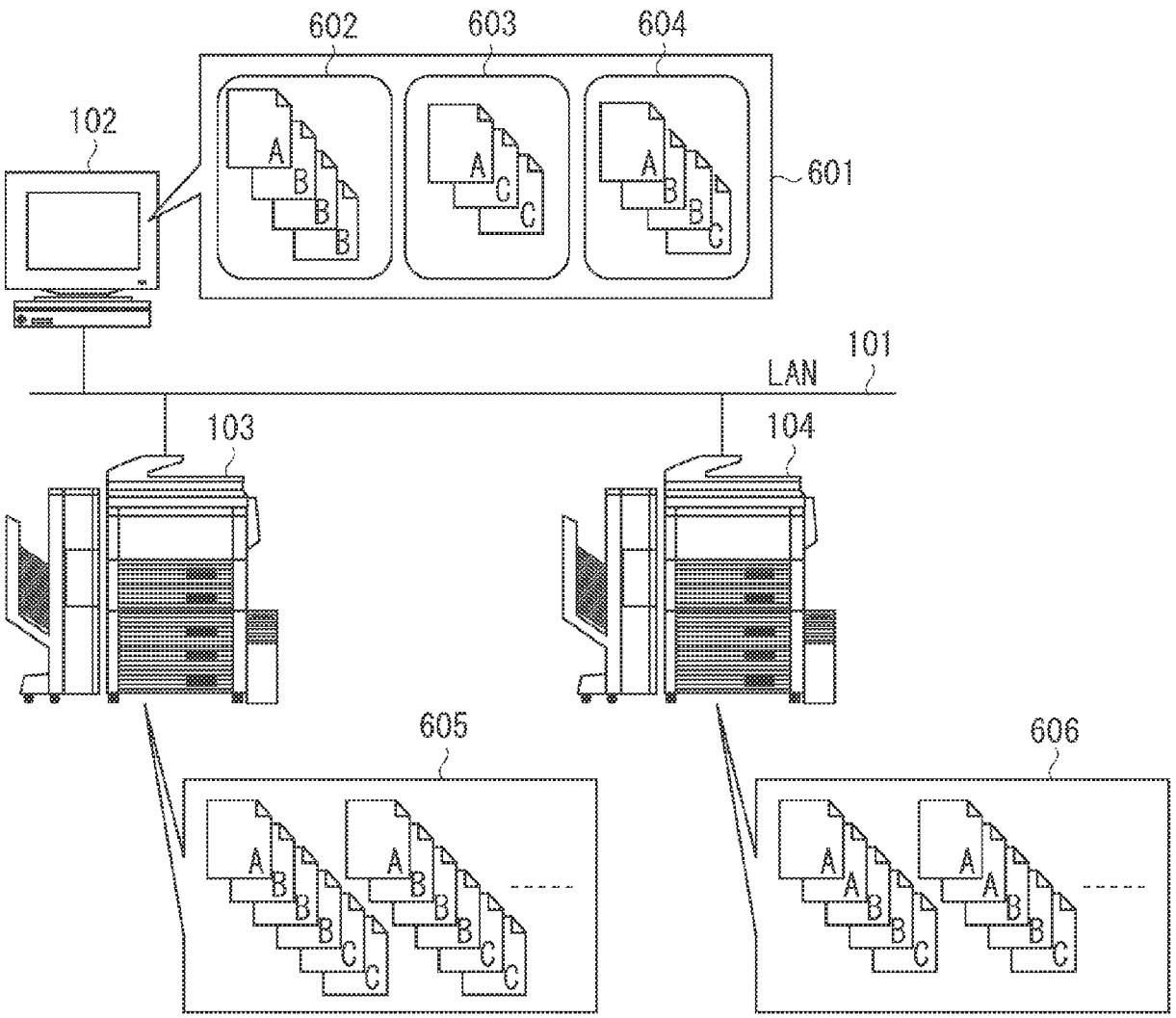
FIG. 6 illustrates an example configuration of a print processing system that is operable according to the flowchart illustrated in FIG. 5.

FIG. 6 illustrates an example configuration of a print processing system that is operable according to the flowchart illustrated in FIG. 5. Compared to the configuration illustrated in FIG. 1, the system configuration illustrated in FIG. 6 includes two MFPs 103 and 104 that are different in type and connected to the LAN 101.

FIG. 6 illustrates a print request 601 that includes three documents 602, 603, and 604 each serving as a unit quantity of print. Each of the documents 602, 603, and 604 constitutes a single document, which can be printed using a single paper set.

Further, FIG. 6 illustrates paper set information 605 being set for a paper feeding tray of the MFP 103 and paper set information 606 being set for a paper feeding tray of the MFP 104.

The paper set information 605 of the MFP 103 indicates that:

one sheet of preprint paper of paper type "A";
three sheets of preprint paper of paper type "B"; and
two sheets of preprint paper of paper type "C", are arranged in this order to constitute a basic paper set composed of a plurality of preprint papers, and a plurality of above-described basic paper sets is placed as a paper stack in one paper feeding tray of the paper feeding device 304.

On the other hand, the paper set information 606 of the MFP 104 indicates that:

two sheets of preprint paper of paper type "A";
two sheets of preprint paper of paper type "B"; and
one sheet of preprint paper of paper type "C", are arranged in this order to constitute a basic paper set composed of a plurality of preprint papers, and a plurality of above-described basic paper sets is placed as a paper stack in one paper feeding tray of the paper feeding device of the MFP 104.

The method described with reference to FIG. 4 can be used to set the paper set information. The paper set information can be stored in the storage device 305 of respective MFPs 103 and 104.

Next, an example case where printing of the contents indicated by the print request 601 is performed by the computer 102 is described below. The print request 601 includes three documents 602, 603, and 604 having the following contents to be referred to in performing print processing.

The document 602 requires one sheet of preprint paper of paper type "A" and three sheets of preprint paper of paper type "B." The document 603 requires one sheet of preprint paper of paper type "A" and two sheets of preprint paper of paper type "C." The document 604 requires one sheet of preprint paper of paper type "A", two sheets of preprint paper of paper type "B", and one sheet of preprint paper of paper type "C."

If the computer 102 receives the above-described print request 601, then in step S501, the CPU 201 determines preprint papers serving as a minimum requirement in performing printing according to the print request 601. According to the above-described numbers of preprint papers required in printing the documents 602 to 604 included in the print request 601, the minimum requirement paper set in printing the documents 602 to 604 is a paper set composed of:

one sheet of preprint paper of paper type "A";
three sheets of preprint paper of paper type "B"; and
two sheets of preprint paper of paper type "C." . . . (1)

In this case, the minimum required number of sheets of each paper type is equal to the maximum number of preprint papers of the corresponding paper type that constitute each of the three documents.

Then, the computer 102 acquires paper set information of the printer selected by a user and determines whether the selected printer can perform printing according to the print request 601. For example, in a case where the MFP 104 is selected, the CPU 201 acquires the paper set information 606 from the MFP 104 as follows:

two sheets of preprint paper of paper type "A";
two sheets of preprint paper of paper type "B"; and
one sheet of preprint paper of paper type "C." . . . (2)

The CPU 201 compares the paper set information (2) acquired from the MFP 104 with the job paper information (1). In this case, the job paper information (1) requires two sheets of the preprint paper of paper type "C", while the paper set information (2) includes only one sheet of the preprint paper of paper type "C."

Therefore, the paper set information of the MFP 104 does not encompass the job paper information. Namely, in step S504, the CPU 201 determines that the print job generated based on the print request 601 is not printable by the MFP 104.

Further, for example, in a case where the MFP 103 is selected, the computer 102 acquires the paper set information 606 from the MFP 103 as follows:

one sheet of preprint paper of paper type "A";
three sheets of preprint paper of paper type "B"; and
two sheet of preprint paper of paper type "C." . . . (3)

The CPU 201 compares the paper set information (3) acquired from the MFP 103 with the job paper information (1). In this case, the paper set information (3) encompasses the job paper information (1) because the number of preprint papers in the paper set information (3) is equal to or greater the minimum required number of preprint sheets in each paper type. Namely, in step S504, the CPU 201 determines that the print job generated based on the print request 601 is printable by the MFP 103.

Figure 7:
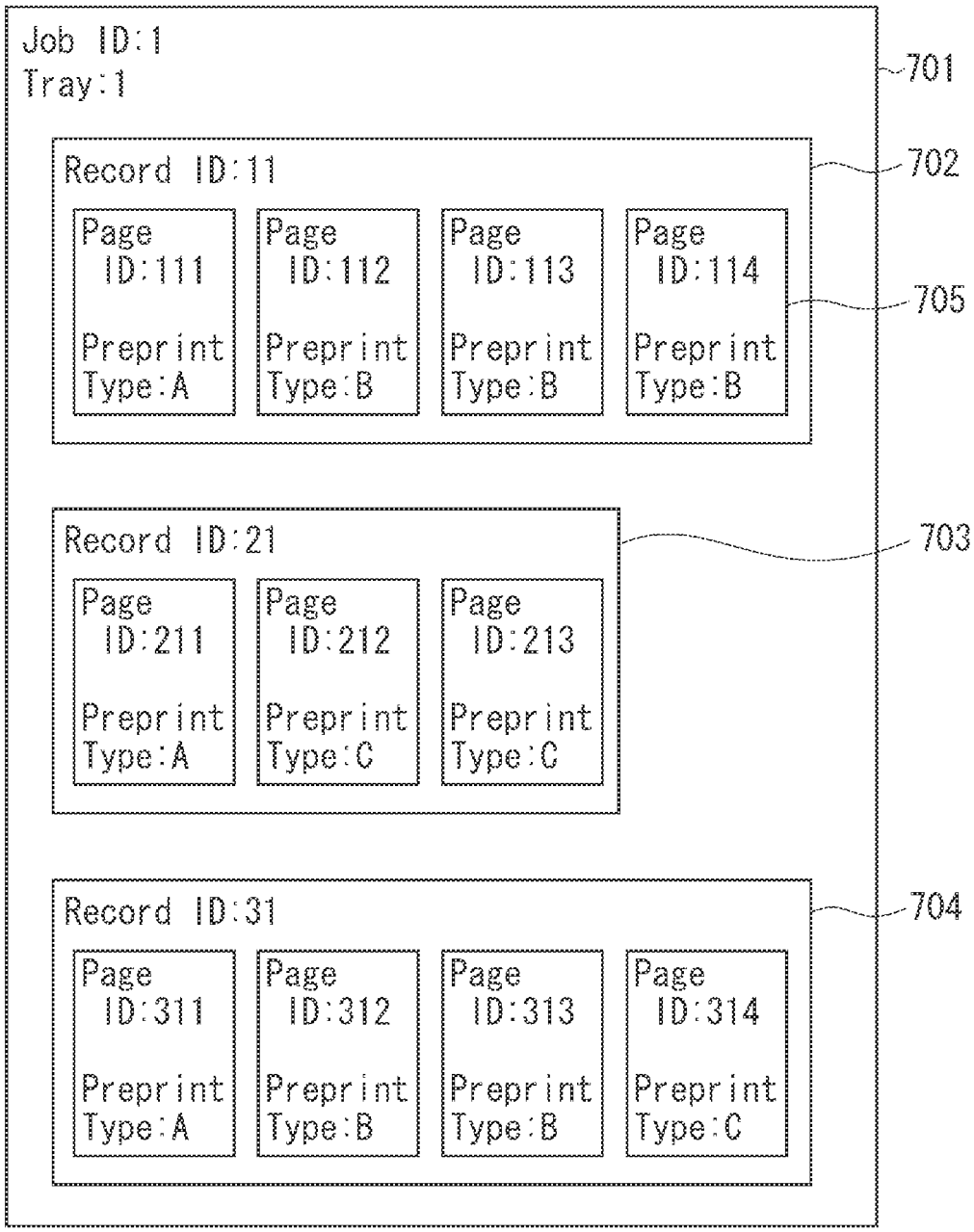
FIG. 7 illustrates a hierarchical configuration of a print job that includes records and pages.

FIG. 7 illustrates an example of the print job generated in step S505 of the flowchart illustrated in FIG. 5, which includes records and pages in a hierarchical relationship included in the print job generated by the CPU 201 based on the print request 601.

A print job 701 illustrated in FIG. 7 includes a job ID allocated to the generated print job. Further, the print job includes information that instructs a paper feeding tray of the MFP to be used in print processing. In FIG. 7, an item "Tray" indicates the information that instructs a paper feeding tray of the MFP and a numerical value "1" is set in the field of this item.

A user can instruct a numerical value to be input in the field of the item "Tray" when the user selects a printer. The numerical value of the item "Tray" can be automatically determined when the paper set information is acquired from a printer for the above-described comparison.

The print job 701 includes at least one record (i.e., a unit quantity of print). The record is generated for each document. The print job 701 includes records 702, 703, and 704 that correspond to three documents 602, 603, and 604 included in the print request 601.

A record ID is allocated to each record so that the record can be identified in the print job 701. The record includes at least one page. The number of generated pages is equal to the number of sheets to be printed. A page ID is allocated to each page. Paper information of a preprint paper to be used in printing of each page is also added to each page. According to the example illustrated in FIG. 7, an item "Page ID" indicates the page ID and an item. "Preprint Type" indicates the paper information of a preprint paper to be used in printing of each page.

Figure 8:
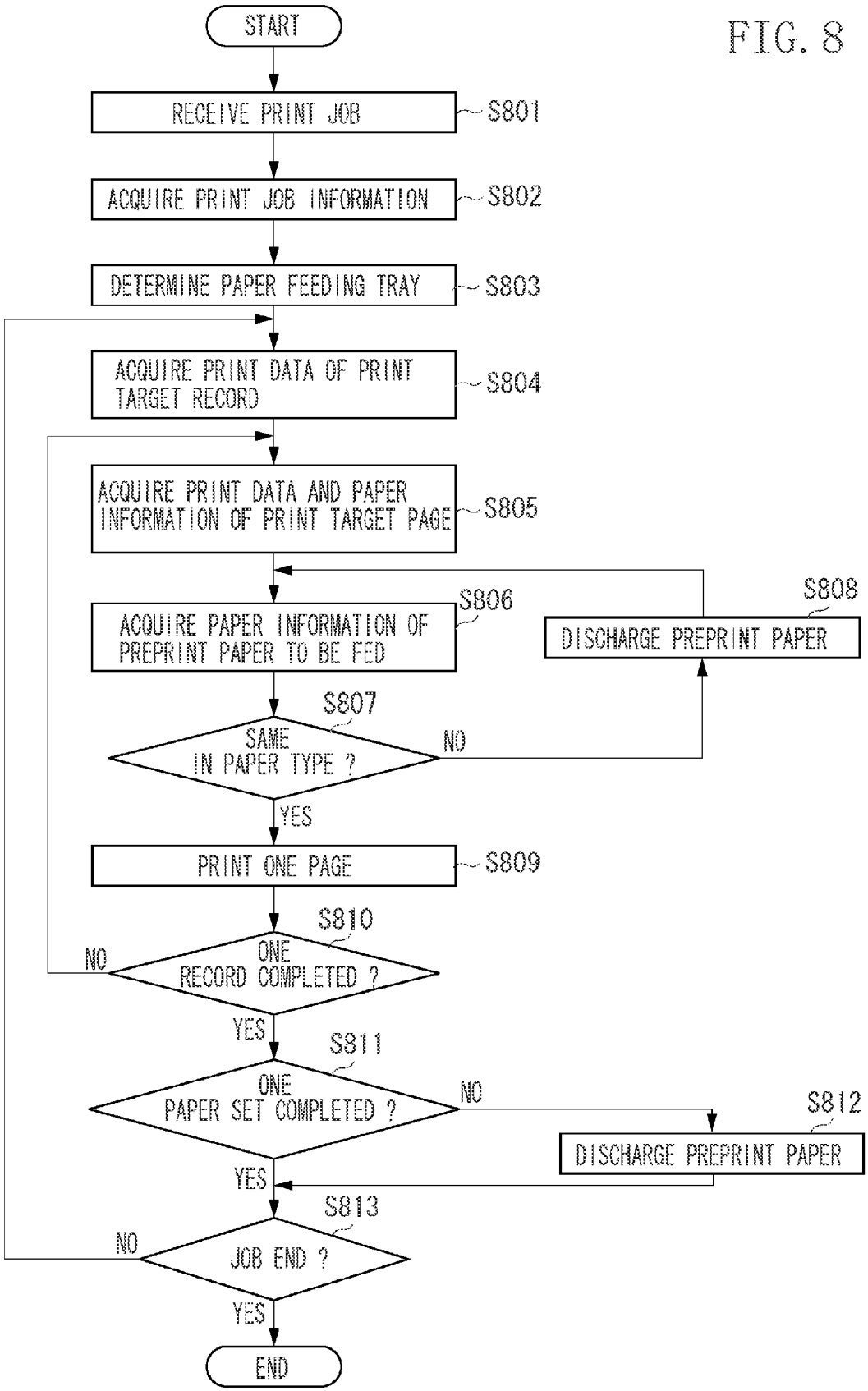
FIG. 8 is a flowchart illustrating an operation of a microprocessor unit according to an exemplary embodiment of the present invention.

FIG. 8 is a flowchart illustrating an operation of the microprocessor unit 311 according to the present exemplary embodiment, which can be performed when the MFP 103 prints a print job received from the computer 102.

First, in step S801, the microprocessor unit 311 receives a print job transmitted from the computer 102 to the MFP 103. The microprocessor unit 311 temporarily stores the received print job into the storage device 305. Then, in step S802, the microprocessor unit 311 acquires information included in the print job referring to the contents of the received print job. In this case, the information acquired from the print job includes print data and job paper information relating to a paper to be used in printing of the print data.

Next, in step S803, the microprocessor unit 311 determines a paper feeding tray to be used in the print processing, which is selected based on the job paper information acquired in step S802. In the present exemplary embodiment, the microprocessor unit 311 determines the paper feeding tray according to the paper feeding tray instruction information explained with reference to FIG. 7.

The determination method is not limited to the above-described method. For example, the microprocessor unit 311 can confirm paper information (e.g., type, order, and number of sheets) with respect to a paper to be used in the print processing of a print job and can determine a paper feeding tray having an optimum paper set information.

Next, in step S804, the microprocessor unit 311 acquires information relating to a print target record (i.e., a record to be subjected to the print processing), which is selected from the print job stored in the storage device 305. Then, the microprocessor unit 311 stores the acquired information into the buffer memory 312. In the above-described processing of step S804, the microprocessor unit 311 can refer to a record ID of each record included in the print job to determine the print target record.

Then, in step S805, the microprocessor unit 311 acquires information (e.g., print data and paper information) relating to a print target page (i.e., a page to be subjected to the print processing), which is selected from the pages included in the print target record. In the above-described processing of step S805, the microprocessor unit 311 can refer to a page ID of each page included in the print target record to determine the print target page.

Next, in step S806, the microprocessor unit 311 acquires paper information relating to a feeding target paper (i.e., a preprint paper that is next fed from the paper feeding tray determined in step S803) with reference to the paper set information being set to the paper feeding tray. Then, in step S807, the microprocessor unit 311 compares the paper information of the print target page acquired in step S805 with the paper information of the feeding target paper acquired in step S806. Then, based on a comparison result, the microprocessor unit 311 determines whether the print target page and the feeding target paper are identical in paper type.

If it is determined that the print target page and the feeding target paper are not identical with each other in the paper information (NO in step S807), then in step S808, the microprocessor unit 311 controls the printer 303 to perform separation processing for discharging the preprint paper without printing any print data corresponding to the print target page on the feeding target paper.

More specifically, the microprocessor unit 311 controls the paper feeding device to feed a preprint paper from a paper feeding tray to the printer 303 and then directly discharge the preprint paper to the outside of the MFP 103 without causing the printer 303 to perform any print operation.

In this case, the microprocessor unit 311 can control the printer 303 to convey the directly discharged preprint paper to a place that is different from the place where the printing processed preprint papers are stored, thereby separating the directly discharged preprint papers from the printing processed preprint papers so that they can be clearly discriminated from each other.

Regarding the above-described separation control, instead of causing the printer 303 to perform a paper feeding operation, it is useful to send the directly discharged paper along a conveyance path that is different from the conveyance path for the printed papers to separate the directly discharged preprint papers from the printing processed preprint papers.

If the preprint paper discharge processing of step S808 is completed, the microprocessor unit 311 restarts the processing of step S806. In step S806, the microprocessor unit 311 acquires paper information relating to a preprint paper to be next fed from the paper feeding tray. Then in step S807, the microprocessor unit 311 performs the above-described comparison processing for the print target page.

On the other hand, if it is determined that the print target page and the feeding target paper are identical with each other in the paper information (YES in step S807), then in step S809, the microprocessor unit 311 causes the printer 303 to feed the feeding target paper. Then, the microprocessor unit 311 performs a print control for controlling the printer 303 to perform printing of print data corresponding to the print target page on the preprint paper having been fed.

If the processing of step S809 (i.e., the print operation for one page) is completed, then in step S810, the microprocessor unit 311 determines whether printing of all pages included in the print target record has been completed with reference to the information relating to the print target record acquired in step S804.

An example of the determination method in step S810 includes storing a record ID of a record that is currently subjected to the print processing and then determining that the printing of all pages included in the print target record has been completed if a record ID of the next print target record is different from the stored record ID.

Another example of the determination method in step S810 includes adding end information (i.e., information indicating the end of the record) to the final page of the record when the print job is generated and then determining whether the printing of all pages included in the print target record has been completed based on the presence of the end information.

If it is determined that the printing of all pages is not yet completed (NO in step S810), the processing returns to step S805 in which the microprocessor unit 311 acquires information relating to the next page included in the print target record as a print target page.

On the other hand, if it is determined that the printing of all pages has been completed (YES in step S810), the microprocessor unit 311 refers to the paper set information. Then, in step S811, the microprocessor unit 311 determines whether all preprint papers included in a single paper set has been fed from the paper feeding tray. Namely, the microprocessor unit 311 determines whether the feeding of one paper set has been completed.

If it is determined that the feeding of one paper set is not yet completed (NO in step S811), then in step S812, the microprocessor unit 311 controls the printer 303 to discharge the rest of the preprint paper remaining in the paper feeding tray, which was prepared for the printing of the print target record.

In performing the determination of step S811, the microprocessor unit 311 can refer to paper set information having been set for the paper feeding tray.

Through the above-described processing, if print data corresponding to the final page of the record is not printed on the last paper of the paper set, all papers following the paper on which the print data corresponding to the final page of the record is printed can be discharged. Then, a new paper set can be used to start printing of the first page of the next print target record.

An example of the determination method in step S811 and an example of the discharge method in step S812 are described below.

When the print target page is the first page of the print target record, the microprocessor unit 311 refers to the paper set information having been set for the paper feeding tray and acquires information relating to the total number of papers consisting of the paper set. The microprocessor unit 311 stores the acquired information.

Then, the microprocessor unit 311 decrements the number of stored remaining papers every time the printing of one page is completed. Then, if the number of the stored remaining papers at the timing of step S811 is equal to 0, the microprocessor unit 311 determines that the feeding of one paper set have been completed. Further, if the number of the stored remaining papers is greater than 0, the microprocessor unit 311 determines that the feeding of one paper set is not yet completed. Thus, in step S812, the microprocessor unit 311 controls the printer 303 to discharge preprint papers corresponding to the number of the stored remaining papers.

If it is determined that the feeding of one paper set has been completed (YE in step S811), or if the preprint paper discharge operation (i.e., the processing in step S812) is completed, then in step S813, the microprocessor unit 311 determines whether printing of all records included in the print job has been completed.

If it is determined that the printing of all records included in the print job is not yet completed (NO in step S813), the processing returns to step S804 in which the microprocessor unit 311 designates the next record as a new print target record and repeats the above-described processing for the next record. On the other hand, if it is determined that the printing of all records included in the print job has been completed (YES in step S813), the microprocessor unit 311 terminates the print job print processing of the flowchart illustrated in FIG. 8.

Figure 9:
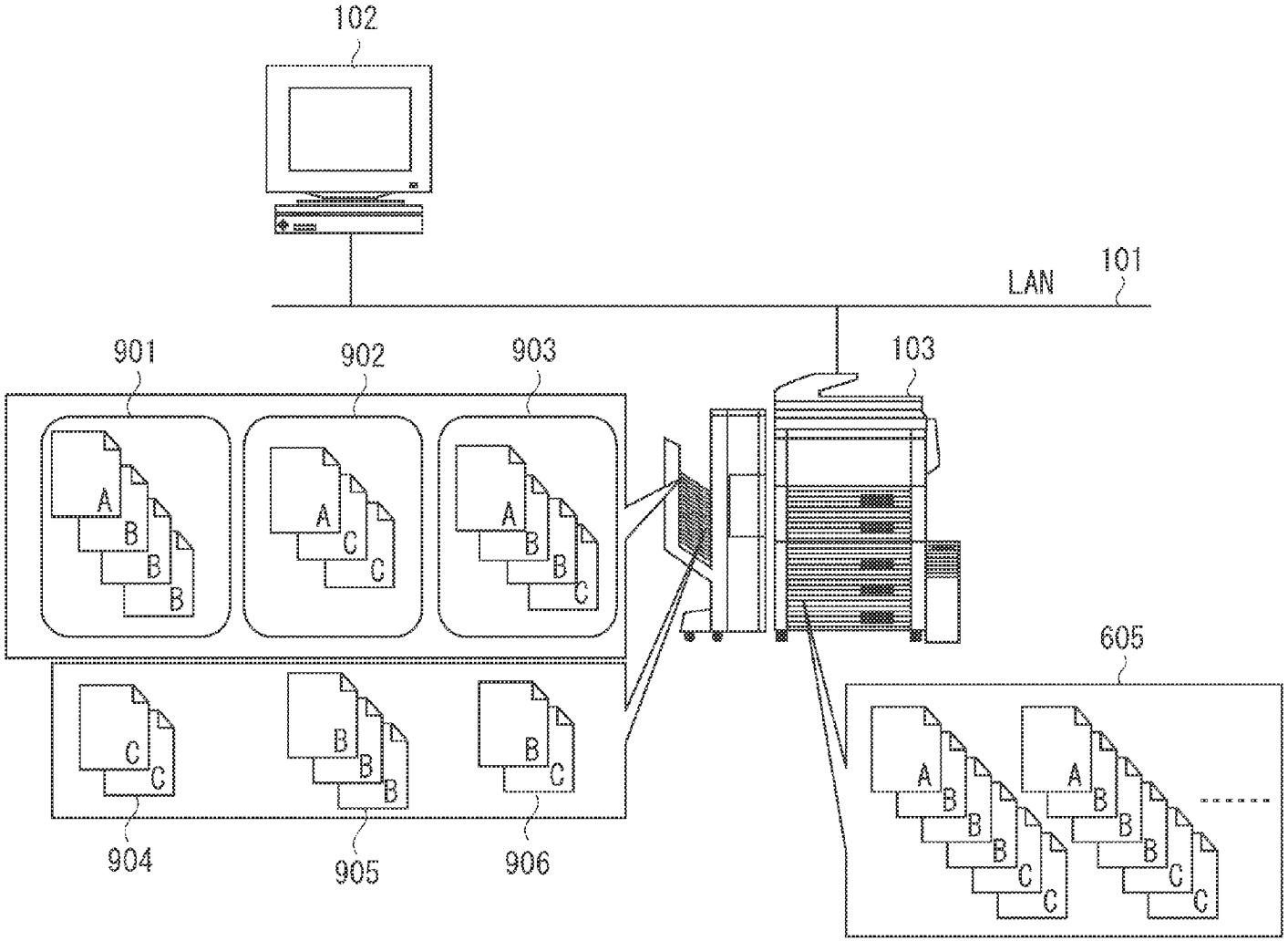
FIG. 9 illustrates an example configuration of a print processing system that is operable according to the flowchart illustrated in FIG. 8.

FIG. 9 illustrates an example configuration of a print processing system that is operable according to the flowchart illustrated in FIG. 8. In FIG. 9, printing of the print job illustrated in FIG. 7 is performed by the MFP 103 to which the paper set information illustrated in FIG. 6 is set beforehand.

If the MFP 103 receives the print job illustrated in FIG. 7, the microprocessor unit 311 performs the above-described processing of steps S801 to S804 to acquire information relating to a print target record. In this case, a record that is assigned a record ID "11" (see 702 in FIG. 7) is the first print target record.

Next, in step S805, the microprocessor unit 311 acquires information relating to a print target page to be printed, which is included in the print target record. In the present exemplary embodiment, a page assigned a page ID "111" is the first print target page. The paper type of this page is "A."

On the other hand, in step S806, the microprocessor unit 311 acquires the paper information 605 illustrated in FIG. 6 having been set beforehand for the predetermined paper feeding tray (i.e., a paper feeding tray selected by Tray=1) of the MFP 103. It is understood, from the paper information 605, that the paper type of the feeding target paper is "A."

In step S807, the microprocessor unit 311 determines that the print target page and the feeding target paper are identical with each other in paper type (i.e., "A").

Then, in step S809, print data corresponding to the page assigned the page ID "111" is printed on a preprint paper fed from the paper feeding device and the print completed preprint paper is discharged. Similarly, pages assigned the page IDs 112 to 114 included in the same record are identical in paper type to the paper set information 605 being set for the paper feeding tray. Therefore, print data of these pages are printed on the preprint papers fed from the paper feeding device and the print completed preprint papers are discharged.

If the printing of the record 702 is accomplished, then in step S811, the microprocessor unit 311 determines whether all preprint papers included in a single paper set has been fed from the paper feeding tray. The single paper set placed in the paper feeding tray is composed of preprint papers of paper types "A", "B", "B", "B", "C", and "C" arranged in this order.

At this moment, one preprint paper of paper type "A" and three preprint papers of paper type "B" have been used to accomplish the printing of the record 702. Therefore, preprint papers of the paper set still remaining in the paper feeding tray is two preprint papers of paper type "C." Therefore, in step S812, the microprocessor unit 311 controls the printer 303 to discharge the remaining preprint papers (i.e., two preprint papers of paper type "C").

Through the above-described processing, the printer 303 discharges four preprint papers 901 on which the print data corresponding to the record 702 has been printed and also discharges two preprint papers 904 on which the print data corresponding to the record 702 has not been printed.

In the present exemplary embodiment, the discharge destination (i.e., a discharge tray) for the preprint papers 904 is differentiated from the discharge destination for the preprint papers 901. The reason why the discharge destinations are differentiated between the printed papers and unprinted papers is to enable users to easily discriminate respective preprint papers. However, any other method, such as "shift discharge", can be used.

If the preprint paper discharge processing of step S812 is completed, then in step S813, the microprocessor unit 311 determines whether the printing of all records included in the print job has been completed. At this moment, printing of two other records (i.e., the record 703 and the record 704) is not yet started. Therefore, the processing returns to step S804 in which the microprocessor unit 311 designates the record 703 as a new print target record. As the first page (i.e., a page assigned a page ID "211") of the record 703 is "A" in paper type, the microprocessor unit 311 starts printing print data of the record 703 in the same manner as that for the record 702.

However, the second page (a page assigned a page ID "212") of the record 703 is "C" in paper type. In other words, the second page of the record 703 is different from the feeding target paper of paper type "B." Therefore, in step S807, the microprocessor unit 311 determines that the print target page is different from the feeding target paper in paper type. Subsequently, in step S808, the microprocessor unit 311 controls the printer 303 to discharge the preprint paper of paper type "B."

At this moment, the preprint papers of the same paper set remaining in the paper feeding tray are "B", "B", "C", and "C" in paper type. Therefore, the microprocessor unit 311 controls the printer 303 to discharge two subsequent sheets (i.e., two preprint papers of paper type "B") without using them for printing of print data. Then, in step S809, the microprocessor unit 311 causes the printer 303 to perform printing of print data of the second and third pages (i.e., pages assigned page IDs "212" and "213") of the record 703 on two preprint papers of paper type "C."

At the timing when the printing of all records of the record 703 is completed, the feeding of one paper set is just completed. Therefore, the microprocessor unit 311 skips the preprint paper discharge processing to be performed in step S812.

Through the above-described processing, the printer 303 discharges three preprint papers 902 on which the print data corresponding to the record 703 has been printed and also discharges three preprint papers 905 on which the print data corresponding to the record 703 has not been printed.

Next, the microprocessor unit 311 designates the record 704 as a new print target record and performs similar processing on print data of the record 704. As a result, the printer 303 discharges four preprint papers 903 on which the print data corresponding to the record 704 has been printed and also discharges two preprint papers 906 on which the print data corresponding to the record 704 has not been printed. Then, in step S813, the microprocessor unit 311 determines that the printing of all records included in the print job has been completed. Thus, the microprocessor unit 311 can accomplish the print processing of the print job 701 that is assigned the job ID "1."

Through the above-described processing, print data can be appropriately printed on papers on which the print data is to be printed, which are selected from a plurality of types of papers that can be fed from the paper feeding tray in processing of a print job.

Further, of the plurality of types of papers that can be fed from the paper feeding tray in processing of a print job, papers other than the papers that are necessary and sufficient to perform printing of print data can be discharged in a state where no print data is printed and separated from the papers on which the print data is printed.

Accordingly, even in a case where the total number of a plurality of paper feeding trays is less than the total number of types of preprint papers, the print processing system according to the present exemplary embodiment can perform print processing using a plurality of types of preprint papers. According to the example illustrated in FIG. 9, the preprint papers 901, 902, and 903 are papers that are necessary and sufficient to perform printing of print data and the preprint papers 904, 905, and 906 are papers that are not necessary for the printing of print data.

In the above-described exemplary embodiment, the print processing system performs printing of print data included in a print job that is composed of at least one record as a unit quantity of print on a plurality of types of preprint papers. However, the present invention is not limited to the above-described exemplary embodiment. The present invention is applicable to any other state where one paper feeding tray stores a plurality of types of mixed papers, which can be used in printing of print data corresponding to a plurality of pages included in a print job.

Figure 10A:
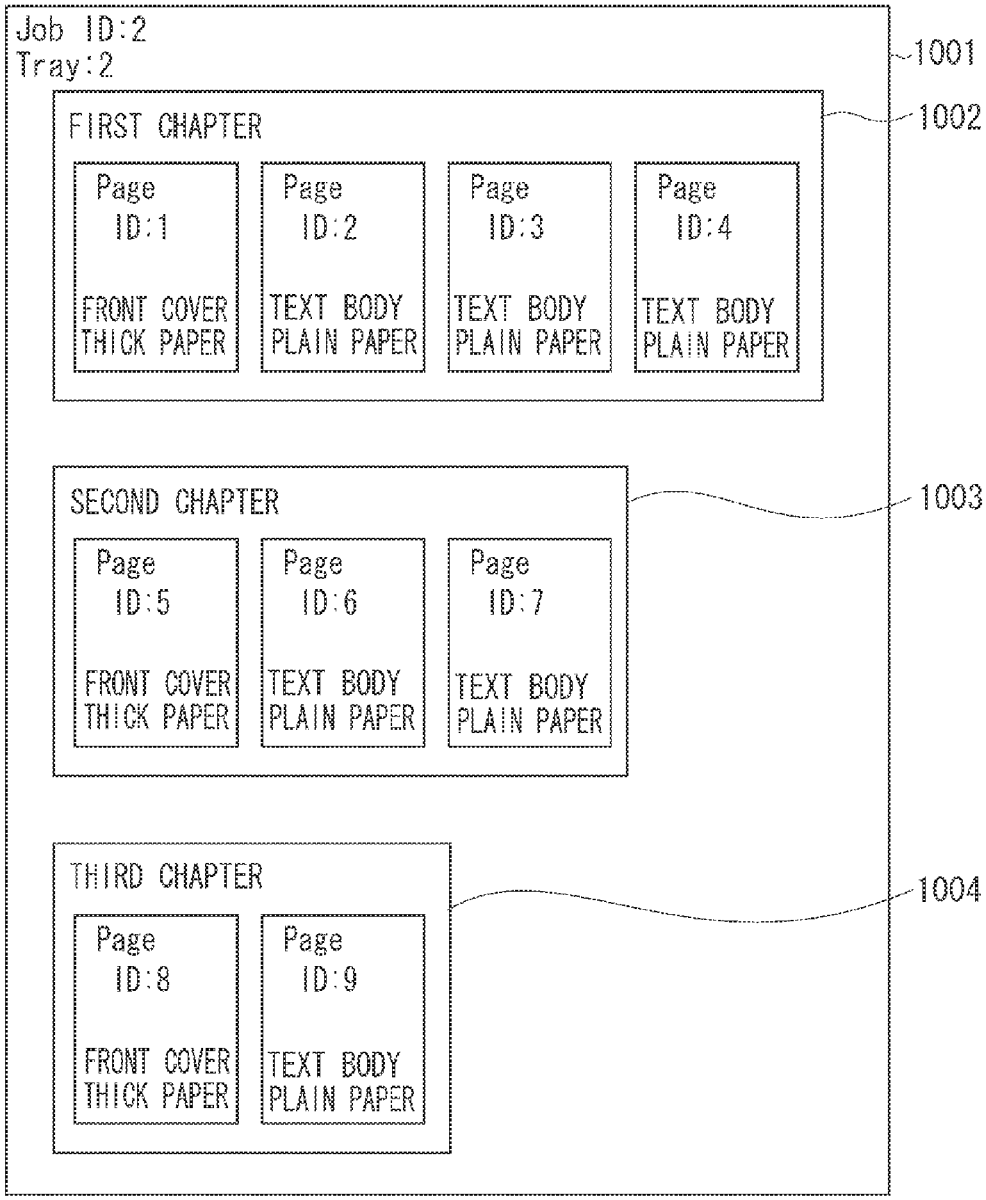
FIG. 10A illustrates an example of a print job applicable to the print processing system according to an exemplary embodiment of the present invention.

FIG. 10A illustrates an example of a print job applicable to the print processing system according to the present invention. A print job 1001 includes three chapters (i.e., a first chapter 1002, a second chapter 1003, and a third chapter 1004) each serving as a unit quantity of print. The first page of each chapter is a front cover that is made of a thick paper. Further, pages that are made of plain papers and constitute a text body follow the front cover. The number of the pages constituting the text body of each chapter is not fixed to a predetermined value. In other words, the number of plain papers on which the text body is printed is variable depending on each unit quantity of print (i.e., each chapter).

Figure 10B:
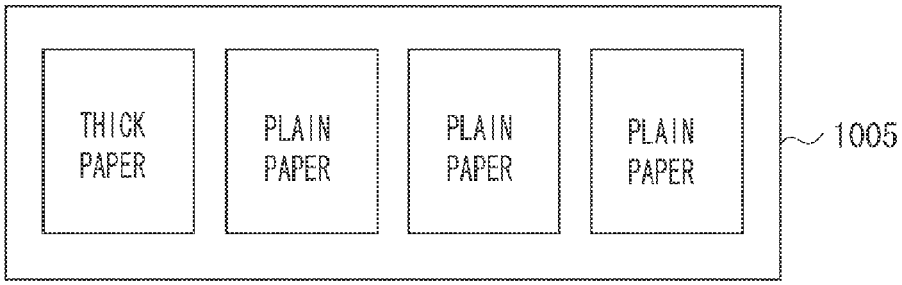
FIG. 10B illustrates an example of a paper set that can be placed in a paper feeding tray of the MFP according to an exemplary embodiment of the present invention.

FIG. 10B illustrates an example of a paper set that can be placed in a paper feeding tray of the MFP in a case where printing of the print job 1001 is performed. A paper set 1005 illustrated in FIG. 10B includes four papers of "thick paper", "plain paper", "plain paper", and "plain paper."

In a state where the paper feeding tray stores a plurality of paper sets 1005 as a paper stack, paper set information corresponding to the paper set 1005 can be set according to a user instruction. The following is a result obtainable if printing of the print job 1001 is performed using the paper set 1005 according to a method similar to the method described in the above-described exemplary embodiment.

The first chapter 1002 included in the print job 1001 is identical to the paper set 1005 in both of paper type and number of sheets. Therefore, the MFP prints print data corresponding to the first chapter 1002 using all of the paper set 1005 and discharges all of the printed four papers.

The second chapter 1003 includes two plain papers, which are one sheet less than the plain papers included in the paper set 1005. Therefore, the MFP prints print data corresponding to the second chapter 1003 on one thick paper and two plain papers and discharges the printed papers. Further, the MFP discharges the remaining one plain paper without printing any print data thereon.

The third chapter 1004 includes only one plain paper, which is two sheets less than the plain papers included in the paper set 1005. Therefore, the MFP prints print data corresponding to the third chapter 1004 on one thick paper and one plain paper and discharges the printed papers. Then, the MFP discharges the two remaining plain papers without printing any print data thereon.

The above-described method according to the present exemplary embodiment enables the MFP to perform printing of a print job with the smallest number of paper feeding trays, even in a case where each unit quantity of print requires a plurality of types of papers and the number of papers of a predetermined type to be used in each unit quantity of print is not the same.

In the present exemplary embodiment, the unit quantity of print that is included in a print job is not limited to the above-described examples (i.e., records and chapters). For example, the unit quantity of print can be any other unit defining one of segmented portions that constitute the entire print job, which can be printed on at least one sheet of paper. Further, the paper type is not limited to the format of each preprint paper or the paper quality (plain paper/thick paper). For example, the size of each paper or any other classification can be used to define the type of each paper.

Further, in the above-described exemplary embodiment, the comparison in paper type was performed for each print target page based on job paper information and paper set information. However, the paper type comparison is not limited to the above-described method. For example, the paper type comparison can be performed for each unit quantity of print. An example method for performing the paper type comparison for each unit quantity of print is described below with reference to the print job 701 and the paper set information 605.

First of all, the paper set information 605 stored in the storage device 305 includes the number of papers of each paper type included in the paper set (i.e., one sheet of paper type "A", three sheets of paper type "B", and two sheets of paper type "C"). The microprocessor unit 311 acquires the number of papers of each paper type to be used in printing of print data corresponding to a record, based on record information included in the print job 701.

More specifically, the information acquired from the record 702 includes one sheet of paper type "A" and three sheets of paper type "B." The information acquired from the record 703 includes one sheet of paper type "A" and two sheets of paper type "C." The information acquired from the record 704 includes one sheet of paper type "A", two sheets of paper type "B", and one sheet of paper type "C."

Then, the microprocessor unit 311 compares the information acquired for each record with the number of sheets of each paper type included in the paper set information. The microprocessor unit 311 subtracts the number of sheets of each paper type included in the paper set information by the number of sheets having the same paper type and required in printing of the target record.

As a result of subtraction processing with respect to the record 702, the microprocessor unit 311 does not obtain any sheets of paper types "A" and "B" but can obtain two remaining sheets of paper type "C". With respect to the record 703, the microprocessor unit 311 does not obtain any sheets of paper types "A" and "C" but can obtain three remaining sheets of paper type "B". Further, with respect to the record 704, the microprocessor unit 311 does not obtain any sheets of paper type "A" but can obtain one sheet of paper type "B" and one sheet of paper type "C."

Based on the above-described subtraction results, the microprocessor unit 311 controls the printer 303 to discharge two sheets of paper type "C", which are a part of the paper set corresponding to the record 702, without printing any print data included in the print job. Further, the microprocessor unit 311 controls the printer 303 to discharge three sheets of paper type "B", which are a part of the paper set corresponding to the record 703, without printing any print data included in the print job.

More specifically, the microprocessor unit 311 controls the printer 303 to discharge one sheet of paper type "B" and one sheet of paper type "C", which are a part of the paper set corresponding to the record 704, without printing any print data included in the print job.

It is needless to say that the microprocessor unit 311 controls the printer 303 to perform printing of print data of each record on the corresponding papers and discharge the printed papers.

As described above, the microprocessor unit 311 compares the number of papers of a predetermined type to be used in printing of print data of each record, which is obtainable from job paper information, with the number of papers of the predetermined type included in the paper set obtainable based on paper set information.

Then, the microprocessor unit 311 controls the printer 303 based on an obtained comparison result so that print data corresponding to the record can be printed on papers of the predetermined type on which the print data of the record should be printed, which are selected from the papers of the predetermined type included in the paper set.

Further, the microprocessor unit 311 prevents the printer 303 from printing any print data corresponding to the record on a surplus paper, which is a part of the papers of the predetermined type included in the paper set, if there is the surplus in the papers of the predetermined type to be used in printing of the print data of the record.

Similar to the above-described first exemplary embodiment, the above-described method enables the print processing system to perform print processing using a plurality of types of preprint papers even in a case where the total number of paper feeding trays is less than the total number of types of preprint papers.

Further, according to the above-described first exemplary embodiment, the paper type comparison was performed for each print target page. For example, in a case where one of three sheets of paper type "B" is discharged, the sheet to be discharged is the final one of the papers having been fed. On the other hand, in a case where the paper type comparison is performed for each unit quantity of print, it is useful to designate beforehand a particular paper (or papers) to be discharged for each unit quantity of print. For example, any one of the above-described three sheets can be designated as a discharge target.

In the above-described exemplary embodiment, the MFP 103 performs the paper type comparison and controls printing and discharge processing. Alternatively, the CPU 201 of the computer 102 can perform comparison of paper information and can control printing and discharge processing based on an obtained result.

In this case, the CPU 201 can generate a print job including information relating to printing of print data to be performed on a paper included in the paper set and separation of a paper that is not used in printing of the print data, based on a comparison result, and can transmit the generated print job to the MFP 103. Then, the MFP 103 can perform print processing according to information included in the received print job. The CPU 201 of the computer 102 performs the print control and the separation control to obtain a print result similar to that of the above-described exemplary embodiment.

Further, according to the separation method described in the above-described exemplary embodiment, papers other than the papers that are necessary and sufficient to perform printing of print data are discharged to a discharge destination that is different from the discharge destination of the papers on which the print data has been printed.

However, the separation method according to the present invention is not limited to the method described in the above-described exemplary embodiment. For example, any other method, such as "shift discharge", can be used.

Further, instead of discharging the surplus papers that are not necessary to perform printing of print data to the outside of the MFP 103, any other tray different from the paper feeding tray that has fed the papers can be used to temporarily store the surplus papers in the MFP 103 in a state where the surplus papers are separated from the printed papers.

Although the present invention has been described with reference to some exemplary embodiments, the present invention is not limited to the above-described exemplary embodiments. Further, the present invention can be realized by executing the following processing. More specifically, a software program that can realize functions of the above-described exemplary embodiments can be supplied to a system or an apparatus via a network or an appropriate storage medium. A computer (or a CPU or a micro processing unit (MPU)) provided in the system or the apparatus can read the supplied software program and execute processing according to instructions of the read program.

In this case, the present invention encompasses the software program itself and a storage medium storing the software program. Further, the present invention is not limited to the above-described exemplary embodiments and can be modified in various ways without departing from the scope of the invention defined by the following claims.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-208193 filed Sep. 9, 2009, which is hereby incorporated by reference herein in its entirety.

What is claimed is:

1. A print processing apparatus that processes a print job printed on a paper stack, the paper stack including a plurality of papers of multiple paper types placed in a tray, comprising:

a storing unit configured to store print data for a plurality of pages to be printed, wherein the print data includes data representing each of a plurality of pages to be printed and paper type data indicating a paper type of the multiple paper types to be used for printing each of the plurality of pages to be printed;

a setting unit configured to set second paper information, wherein the second paper information indicates a paper stacking order of the paper stack, wherein the paper stacking order represents the paper types and order of the papers in the paper stack;

a comparison unit configured to compare the type of paper to be used in printing a current page data, which is a portion of print data representing a page to be printed of the plurality of pages to be printed and a paper type date of the page to be printed, with the type of paper of a current paper of the paper stack;

a print control unit configured to control a printing unit to print the current page data on the current paper when the comparison unit determines the type of paper of the current page data is the same as the type of paper of the current paper of the paper stack; and a separation control unit, configured to control a separation unit to separate the current paper of the paper stack from the paper stack when the comparison unit determines that the type of paper of the current page of print data is different from the type of paper of the paper stack.

2. The print processing apparatus according to claim 1, wherein the comparison unit is configured to compare a type of a paper to be used in printing of print data corresponding to each print target page, which is obtainable from the first paper information, with a paper type of a feeding target paper that is obtainable from the second paper information, the print control unit is configured to control the printing unit so that print data corresponding to the print target page can be printed on the feeding target paper, if it is determined based on the comparison result obtained by the comparison unit that the type of the paper to be used in printing of the print data corresponding to the print target page, which is obtainable from the first paper information, is identical to the paper type of the feeding target paper that is obtainable from the second paper information, the separation control unit is configured to control the separation unit so that the surplus paper can be separated from the target paper, if it is determined based on the comparison result obtained by the comparison unit that the type of the paper to be used in printing of the print data corresponding to the print target page, which is obtainable from the first paper information, is not identical to the paper type of the feeding target paper that is obtainable from the second paper information.

3. The print processing apparatus according to claim 1, wherein the print data includes at least one unit quantity of print that includes at least one page, the setting unit is configured to set, as the second paper information, information relating to the stacking order of a paper set that includes the plurality of types of papers constituting the paper stack placed in the paper feeding tray, the comparison unit is configured to compare a number of papers of each type to be used in printing of the print data of each unit quantity of print, which is obtainable from the first paper information, with a number of papers of each type included in the paper set that is obtainable from the second paper information, the print control unit is configured to control the printing unit based on the comparison result obtained by the comparison unit so that print data corresponding to the unit quantity of print can be printed on papers of a predetermined type, which is a part of the papers of the predetermined type included in the paper set, to be used in printing of the print data of the unit quantity of print, and the separation control unit is configured to control the separation unit, if it is determined based on the comparison result obtained by the comparison unit that there is any surplus in the papers of the predetermined type included in the paper set, which is other than the target paper, so that the surplus paper can be separated from papers on which the print data corresponding to the unit quantity of print has been printed.

4. The print processing apparatus according to claim 3, wherein the unit quantity of print is at least one of a record and a chapter included in the print job.

5. The print processing apparatus according to claim 1, wherein the separation control unit is configured to control the separation unit so that the paper to be separated from the target paper is separated in a state where no print data is printed.

6. The print processing apparatus according to claim 1, wherein the separation control unit is configured to control the separation unit so that a paper other than the target paper, which is a part of the plurality of types of papers fed from the paper feeding tray in processing of the print job, can be discharged to a discharge destination that is different from a discharge destination of the papers on which the print data has been printed.

7. The print processing apparatus according to claim 1, wherein the type of paper is at least one of format type, paper type, and paper size type of a preprint paper.

8. A method for controlling a print processing apparatus that processes a print job printed on a paper stack, the paper stack including a plurality of papers of multiple paper types placed in a tray, the method comprising:

storing print data for a plurality of pages to be printed, wherein the print data includes data representing each of a plurality of pages to be printed and paper type data indicating a paper type of the multiple paper types to be used for printing each of the plurality of pages to be printed;

setting second paper information, wherein the second paper information indicates a paper stacking order of the paper stack, wherein the paper stacking order represents the paper types and order of the papers in the paper stack;

comparing the type of paper to be used in printing a current page data, which is a portion of print data representing a page to be printed of the plurality of pages to be printed and a paper type date of the page to be printed, with the type of paper of a current paper of the paper stack;

controlling a printing unit to print the current page data on the current paper when it is determined that the type of paper of the current page data is the same as the type of paper of the current paper of the paper stack; and, controlling a separation unit to separate the current paper of the paper stack from the paper stack when it is determined that the type of paper of the current page of print data is different from the type of paper of the paper stack.

* * * * *